United States Patent [19]

Oesterle et al.

[11] 4,427,038

[45] Jan. 24, 1984

[54] ACTUATION DEVICE FOR THE DRIVE GEAR OF A WEFT THREAD CARRIER OF A SHUTTLELESS LOOM

[75] Inventors: Gerhard Oesterle, Koblach, Austria; Rudolph Jaeger, Frasnacht, Switzerland; Willibald Auer, Arbon, Switzerland; Hermann Unfried, Arbon, Switzerland

[73] Assignee: Aktiengesellschaft Adolf Saurer, Arbon, Switzerland

[21] Appl. No.: 260,339

[22] Filed: May 4, 1981

[30] Foreign Application Priority Data

May 21, 1980 [CH] Switzerland ..... 3947/80

[51] Int. Cl.[3] ..... D03D 47/00

[52] U.S. Cl. ..... 139/449

[58] Field of Search ..... 139/449, 441, 444, 445, 139/446

[56] References Cited

U.S. PATENT DOCUMENTS

| | | | |
|---|---|---|---|
| 2,165,890 | 7/1939 | Foster | 139/449 |
| 4,041,991 | 8/1977 | Dewas | 139/449 |
| 4,070,918 | 1/1978 | Fuentes | 139/449 |

FOREIGN PATENT DOCUMENTS

| | | | |
|---|---|---|---|
| 2907629 | 9/1980 | Fed. Rep. of Germany | 139/449 |

*Primary Examiner*—Henry Jaudon

*Attorney, Agent, or Firm*—Werner W. Kleeman

[57] ABSTRACT

An actuation device for a drive element, such as the drive gear of a gripper needle encompasses a box which can be attached to the sley of a shuttlesess loom. Accommodated in this box is a traction means-transmission or drive containing a toothed belt of a drive pulley or disc which is operationally connected with the drive gear and a tensioning pulley or disc. The run of the toothed belt extends essentially parallel to a slide guide for a slide which is fixedly connected with the aforementioned belt run. The slide or carriage is moved to-and-fro by means of a lengthwise adjustable intermediate rod through the action of a crank drive. The adjustable spacing between the reversal points of the slide constitutes a measure for the insertion depth of the weft thread carrier into the shed. This enables a simple and robust as well as adaptable conception by means of which there can be obtained an extremely precise and unchanging insertion depth of the weft thread carrier into the weaving shed.

9 Claims, 3 Drawing Figures

102
2
1
10
8
13
34
11
100
33
2-2
30
5
35
7
35
31
20
32
9
40
26
24
22
23
28
21
25
12

ACTUATION DEVICE FOR THE DRIVE GEAR OF A WEFT THREAD CARRIER OF A SHUTTLELESS LOOM

BACKGROUND OF THE INVENTION

The present invention relates to a new and improved construction of an actuation device or mechanism for a drive element, such as a drive gear of a weft thread carrier of a shuttleless loom, the weft thread carrier being guided by a gripper tape or band or the like.

Generally speaking, the actuation device of the present development is of the type wherein the drive gear is operatively connected with a crank drive by means of a transmission element of a slipless traction means-power transmission or drive. This crank drive moves to-and-fro a linearly guided carriage or slide which is connected for movement with the traction means-drive.

Equipment of this type is required, for instance, at so-called rapier or gripper looms, in order to impart the requisite to-and-fro movement to the gripper bands or tapes for the alternate weft thread insertion into the shed and for weft thread transfer from one gripper to the other. The drive mechanism in conjunction with the gripper tapes are located upon the sley which oscillates back-and-forth.

An actuation device suitable for this purpose is known to the art from German Patent No. 2,637,819, granted July 19, 1979 wherein the crank drive actuates a pivotal or oscillatory lever which is mounted coaxially with the drive gear and there is provided a drive belt pulley or disc fixedly connected with the drive gear. The pivotal or oscillatory lever carries at its free end a respective deflection roll or roller for each run or strand of a toothed belt which is trained about the belt pulley or disc. The ends of the belt strand or run are each retained in fixed anchors at the loom frame.

From the publication "Melliand Textilbericht" 6/1977, pages 469 et seq. and from the German Patent publication No. 2,628,402, published Dec. 30, 1976, there are known in this technology actuation devices of the aforementioned type wherein a linearly guided slide shoe provided with a respective deflection roll for each run of a toothed belt which trains about the drive pulley or disc of a drive gear is actuated by a crank drive. Each belt run is guided between the slide shoe and the drive belt pulley means of a respective deflection roll arranged in the extension of the path of movement of the slide shoe and the belt run ends likewise are each fixedly anchored at the loom frame.

There heretofore known actuation devices possess the common drawback that the laws of motion of the weft thread-insertion means is uncontrollable, since the belt strand or run which is tensionally loaded in each instance possesses an appreciable length and therefore is capable of extensively elongating. In particular, the dead-center points of the weft thread-insertion means can alter as a function of the rotational speed of the loom, since the traction forces, and thus, the belt elongation can vary, as is known, as a function of the square of the rotational speed. Consequently, there exist appreciable difficulties at looms equipped with a respective weft insertion element penetrating from each side into the shed wherein the weft thread is transferred from one insertion element to the other, since the inter-engagement of the gripper heads is decisive for proper thread transfer, both as concerns the mutual penetration depth of the insertion elements and also with respect to the relative velocity thereof. Additionally, an accommodation of the weft thread-insertion drive to different cloth or fabric widths only can be accomplished by performing cumbersome and time-consuming resetting operations at the belt drive and at the anchoring points of the belt ends, if it is intended to maintain the precise dead-center position of the weft insertion means in the shed because of the weft thread transfer as well as the belt tension.

Moreover, this belt tension changes during the course of the oscillatory movement of the pivotal or oscillatory lever carrying the deflection roll of the equipment disclosed in the aforementioned German Patent No. 2,638,819, because the circular configured path of movement of the deflection rolls deviates markedly from an ellipse, with the anchoring points constituting the focal points, which such deflection rolls must describe, in order that the total length of the belt sections remains constant between the deflection rolls and the anchoring points.

SUMMARY OF THE INVENTION

Therefore, with the foregoing in mind it is a primary object of the present invention to provide a new and improved construction of an actuation device for a drive element, typically the drive gear of a weft thread carrier of a shuttleless loom which is not associated with the aforementioned drawbacks and limitations of the prior art constructions heretofore discussed.

Another and more specific object of the present invention aims at providing a new and improved construction of an actuation device of the previously mentioned type which avoids the disadvantages of the heretofore known arrangements and which, with comparatively simple conceptional design, even when used over longer periods of time, guarantees for continuously precisely defined dead-center positions as well as enabling an easy and positive system adaptation to different fabric widths.

A further significant object of the present invention relates to the provision of a new and improved construction of an actuation device for the drive gear of a weft thread carrier of a shuttleless loom, which is relatively simple in construction and design, extremely economical to manufacture, highly reliable in operation, not readily subject to breakdown or malfunction, and requires a minimum of maintenance and servicing.

Now in order to implement these and still further object of the invention, which will become more readily apparent as the description proceeds, the actuation device of the present development is manifested by the features that the toothed belt of the traction means-drive wraps in an endless configuration about both a drive disc or pulley operationally arranged for rotation at the drive gear and also about a tensioning pulley or disc which is spaced from the drive pulley. At least one run of the toothed belt extends essentially parallel to the guide of the slide or carriage which is fixedly connected with such belt run. The length thereof corresponds to the largest spacing of the reversal or deflection points determining the maximum insertion depth of the weft thread carrier into the shed. The spacing of the deflection of reversal points of the slide is adjustable by performing a length change at the crank drive.

A preferred construction of the inventive actuation device resides in an arrangement wherein the traction means-drive is located in a box which is open at the side of the slide or carriage and is connectable with the sley of a loom in the form of a sley word. The side walls of the box form the guides of the slide.

To accomplish an easy and rapid accommodation of the described arrangement to other cloth or fabric widths the construction advantageously is perfected such that the crank rod of the crank drive is connected by means of a lengthwise adjustable intermediate rod with the slide. Furthermore, to accomplish a change in the stroke length of the slide the bearing journal of the crank rod which revolves eccentrically with the crank drive gear is supported to be radially adjustable at the crank drive gear or equivalent structure.

Furthermore, an advantageous additional design of the inventive actuation device is manifested by the features that a pivotal or oscillatory lever is additionally supported at one end between the crank rod and the intermediate rod. This pivotal lever relieves the slide from the effective side or lateral forces of the crank rod and governs the path of movement of the intermediate rod. The other end of the pivotal or oscillatory lever is hingedly connected at the machine or loom frame.

Due to these measures it is now possible to precisely define and maintain constant the reversal points of the slide or carriage and thus the insertion depth of the related weft thread carrier into the shed, since the slide directly transmits its defined stroke movement by means of the transmission element to the tape or band gear, without there being effective length changes at the transmission element, such changes being compensated by the tensioning pulley or disc. Additionally, the inventive measures ensure for placement of the reversal point of the carriage for the greatest insertion depth of the weft thread carrier close to the drive gear, so that elongations occurring at the transmission element due to the effective reversal forces become negligible. Moreover, the stroke of the slide, and thus, the insertion depth of the related weft thread carrier into the shed can be easily and rapidly adjusted by performing length changes at the intermediate rod and radially displacing the bearing journal or pin of the crank rod. Furthermore, the simple conception of the inventive actuation device allows for retrofitting thereof at existing looms.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
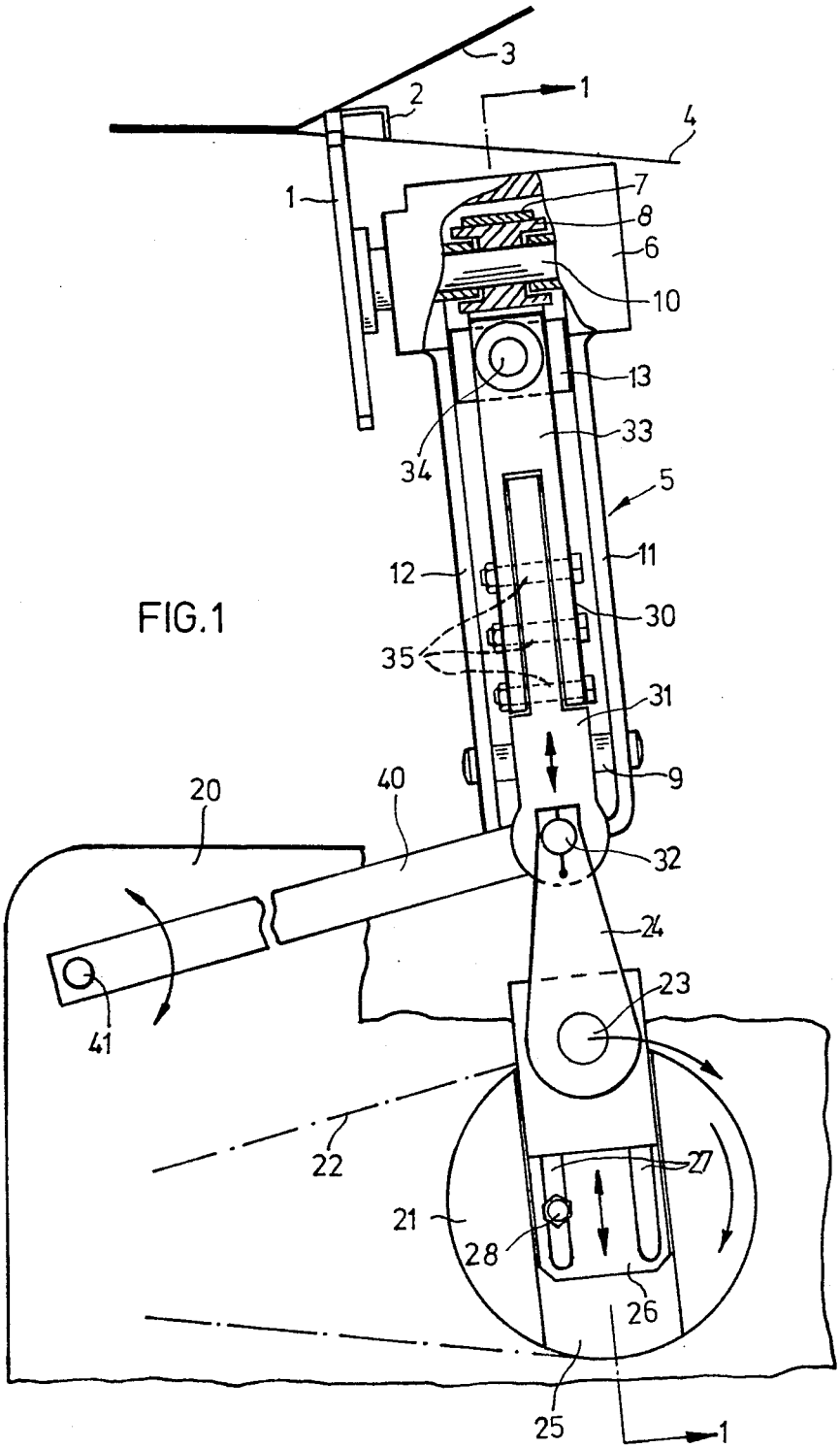
FIG. 1 is a schematic side view of an actuation device or mechanism according to the invention arranged at the sley of a shuttleless gripper loom.

Describing now the drawings, it is to be understood that only enough of the construction of the loom has been shown to enable those skilled in the art to readily understand the underlying principles and concepts of the present development. Turning attention now specifically to FIG. 1, there will be seen an exemplary embodiment of actuation device or mechanism for a drive element, such as the drive gear 1 for the gripper needle 2 or equivalent structure of a shuttleless loom, which has been merely generally represented by the weaving shed formed by the raised or upper warp threads 3 and the lower or lowered warp threads 4. This actuation device comprises a box 5 or the like which is fixedly connected in the form of a sley 100 with the here schematically shown sley 102 of the loom, as shown in FIG. 2.

The entire arrangement oscillates back-and-forth along with the sley 102 for the purpose of inserting the weft thread into the shed and for beating-up the layed weft thread against the cloth or fabric fell. Such movement is generally known in the weaving art and therefore need not here be further explained, particularly since it does not constitute subject matter of the present development and is conventional.

The box 5 transforms at its end closer to the shed into a bearing or support head 6 in which there is rotatably supported the drive gear 1 by means of conventional and therefore not here further shown bearing means. The box 5 extends downwardly in the form of a substantially U-shaped profile or sectional member which opens towards the outside of the loom. In the internal space or interior of such box 5 there is accommodated a traction means-drive comprising a toothed belt 7, a drive pulley or disc 8 and a tensioning pulley or disc 9. The drive pulley 8 is operatively connected for rotation with the shaft 10 of the drive gear 1 or equivalent drive element, whereas the tensioning pulley or disc 9 is freely rotatably mounted at the lower end of the box or casing 5. Such mounting can be accomplished with the aid of conventional mounting or support means and there can be provided adjustment or setting means which can be actuated manually or automatically for the purpose of tightening the toothed belt 7 or equivalent structure. Since such arrangement does not constitute subject matter of the present invention it is unnecessary to describe the same in detail.

Figures 2, 3:
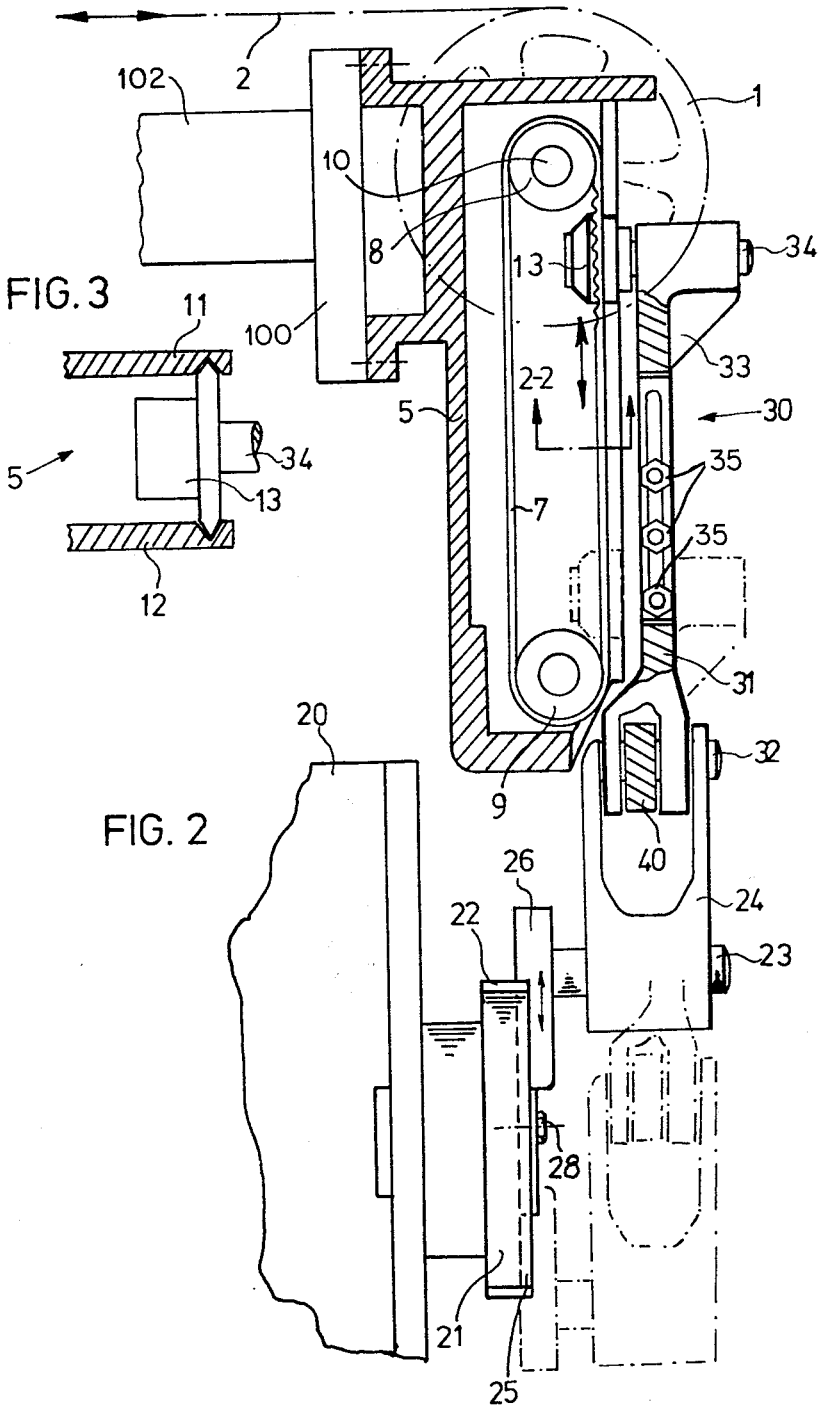
FIG. 2 is a schematic front view of the arrangement shown in FIG. 1, shown partially in sectional view taken substantially along the section line 1—1 of FIG. 1.
FIG. 3 illustrates a detail of the arrangement according to FIGS. 1 and 2 in schematic illustration and in sectional view, taken substantially along the section line 2—2 of FIG. 2.

As will be particularly evident by referring to FIG. 2 a run or strand of the toothed belt 7 extends near to the upper edges of the side walls 11 and 12 of the box 5 and essentially parallel thereto. These side walls 11 and 12 thus simultaneously form rail guides for a slide or carriage 13 which is fixedly clamped or otherwise appropriately attached at the toothed belt 7. By means of the slide 13, which can be moved up and down in the showing of the drawing of FIGS. 1 and 2, it is thus possible to place the drive gear 1 or element 7 into an oscillatory movement and therefore to move the gripper needle 2 into and out of the weaving shed. It will be clearly seen that the spacing between the belt pulleys 8 and 9, and thus, the run or strand length of the toothed belt 7 governs the outermost deflection or reversal points of the slide 13 and defines a measure for the insertion depth of the weft thread carrier into the shed.

At this location it is expressly mentioned that the shape of the box 5, the construction of the carriage or slide 13 and its guide means also can be differently carried out. For instance, the box can be closed and there can be established a connection with the slide or carriage 13 towards the outside through a longitudinal slot. For instance, it is furthermore possible to allow the slide to move back-and-forth upon a guide rod.

The to-and-fro movement of the gripper needle 2 and the up-and-down movement of the slide or carriage 13 needed for this purpose is here initiated by way of example by a crank drive. The crank drive comprises a crank drive gear 21 which is rotatably supported in conventional manner at a loom frame portion or part 20 and in likewise conventional fashion is driven by a here not further shown main or primary shaft of the loom, as such has simply been schematically indicated by the phantom lines 22. Revolving eccentrically with such crank drive gear 21 or equivalent structure is a bearing pin or crankpin 23 for a crank rod 24. In order to be able to radially displace this bearing or crankpin 23 for the purpose of accomplishing the previously discussed stroke change, the end face or side of the crank drive gear 21 is provided with a diagonal groove or slot 25 into which there is inserted a displaceable slide piece or element 26 which supports the bearing or crankpin 23. The desired positional fixation of the slide or block element 26 at the crank drive gear 21 is accomplished, for instance, by threaded bolts 28, only one of which has been particularly shown in the drawings and which piercingly extend through longitudinal slots 27.

As will be further seen by referring to FIGS. 1 and 2, the free or upper end of the crank rod 24 is connected with the slide or carriage 13 by means of a lengthwise adjustable intermediate rod or rod member 30. To this end a suitable hinge connection containing a schematically indicated hinge bolt or pin 32 is provided between a first part 31 of the intermediate rod 30 and the crank rod 24. Furthermore, the free end of a second part 33 of the intermediate rod is rotatably mounted upon a pin 34 which protrudes from the slide 13. Both of the interfitting parts 31 and 33 of the intermediate rod 30 are constructed such that they can be telescoped within one another to perform the previously discussed length changes and are releasably connected in desired position by the threaded bolts 35 or equivalent fixation means, as the same has been generally schematically indicated in FIGS. 1 and 2.

It is also expressly mentioned that the described intermediate rod 30 can have a different construction and design from that which has been here illustrated by way of example and not limitation. For instance, its length changes also can be accomplished by using sleeve or spindle means.

Further, by reverting to FIGS. 1 and 2 it will be seen that there is additionally supported one end of a pivotal or oscillatory lever 40 at the hinge connection or pivot 32 provided between the crank rod 24 and the intermediate rod 30. The other end of this pivotal or oscillatory lever 40 is hingedly connected by means of a bolt 41 or equivalent structure at the loom frame 20. This pivotal or oscillatory lever 49 relieves the slide or carriage 13 from the effective lateral or side forces of the crank rod 24 and determines the path of movement of the intermediate rod or element 30.

From the showing of FIGS. 1, 2 and 3 there will be recognized that the previously described actuation device or mechanism is of extremely simple and robust design. Moreover, there can be produced an exact and practically non-altering or essentially constant stroke movement between both of the extreme positions of the slide 13 which have been shown in FIG. 2. Additionally, there is possible at any time an easy accommodation or adaptation of the stroke length between the outermost terminal positions to possibly desired changes in the woven fabric or cloth width.

While there are shown and described present preferred embodiments of the invention, it is to be distinctly understood that the invention is not limited thereto, but may be otherwise variously embodied and practiced within the scope of the following claims. Accordingly,

What we claim is:

1. An actuation device for a drive element of a weft thread carrier of a shuttleless loom which is guided by a gripper tape, comprising:

a crank drive;

a substantially slipless traction means-drive containing a toothed belt;

a drive element operatively connected with the crank drive by means of the toothed belt of said substantially slipless traction means-drive;

a linearly guided slide operatively connected for movement with the toothed belt;

said crank drive moving said linearly guided slide back-and-forth;

said traction-means drive further comprising:

a drive pulley operatively connected for rotation with the drive element;

a tensioning pulley arranged in spaced relationship from said drive pulley;

said toothed belt of said traction means-drive being wrapped in an endless configuration about said drive pulley and said tensioning pulley;

guide means provided for said slide;

at least one run of said toothed belt extending essentially parallel to said guide means for said slide;

said slide being fixedly connected with said one run of said toothed belt;

the length of said one run essentially corresponding to the greatest spacing of reversal points of the slide and which govern the maximum insertion depth of the weft thread carrier into a shed of the loom;

means for adjusting the spacing of the reversal points of the slide;

box means open towards the side of the slide;

said box means having side walls forming said guide means for said slide;

said box means being connected with a sley of the loom in the form of a sley sword; and said traction means-drive being located within said open box means.

2. The actuation device as claimed in claim 1, wherein:

said adjustment means enables accomplishing length changes at said crank drive.

3. The actuation device as defined in claim 1, wherein:

said drive element comprises a drive gear.

4. The actuation device as defined in claim 1, wherein:

said crank drive comprises a crank rod;

said adjusting means comprises a lengthwise adjustable intermediate rod; and said crank rod of said crank drive being connected by means of said lengthwise adjustable intermediate rod with the slide.

5. The actuation device as defined in claim 4, wherein:

said crank drive further includes a crank drive gear;

said crank rod containing a bearing pin which revolves eccentrically with the crank drive gear; and said bearing pin being supported to be radially adjustable at the crank drive gear in order to perform a change in the stroke length of the slide.

6. The actuation device as defined in claim 4, further including:

hinge connection means provided between said crank rod and said intermediate rod;

an oscillatory lever supported at one end thereof at said hinge connection means;

said oscillatory lever relieving the slide from laterally effective forces of the crank rod and governing the path of movement of the intermediate rod;

a loom frame; and means for hingedly connecting said oscillatory lever at its other end which is opposite said one end with said loom frame.

7. The actuation device as defined in claim 4, wherein:

said adjustable intermediate rod extends substantially in a plane of symmetry of said toothed belt in an upper dead-center position of said slide.

8. The actuation device as defined in claim 1, wherein:

said crank drive comprises a crank rod;

said adjusting means comprises a lengthwise adjustable intermediate rod; and said crank rod of said crank drive being connected by means of said lengthwise adjustable intermediate rod with said slide.

9. The actuation device as defined in claim 1, wherein:

said crank drive moves said linearly guided slide back-and-forth between an upper dead-center position and a lower dead-center position;

said toothed belt of said traction means-drive being solely wrapped in an endless configuration about said drive pulley and said tensioning pulley; and said crank drive comprising a crank rod which in said upper dead-center position of said slide substantially extends in a plane of symmetry of said toothed belt.

* * * * *